US005660452A

United States Patent [19]

Bales et al.

[11] Patent Number: 5,660,452

[45] Date of Patent: Aug. 26, 1997

[54] INDICATOR LIGHT FOR AN APPLIANCE

[75] Inventors: Michael Bales, New Palastine; Mark A. Pickering, Lebanon, both of Ind.

[73] Assignee: Maytag Corporation, Newton, Iowa

[21] Appl. No.: 519,199

[22] Filed: Aug. 25, 1995

[51] Int. Cl.[6] ..... F21V 33/00

[52] U.S. Cl. ..... 362/29; 362/92

[58] Field of Search ..... 362/23, 92, 29; 126/39 BA, 42, 39 E; 219/220, 487

[56] References Cited

U.S. PATENT DOCUMENTS

| | | | |
|---|---|---|---|
| 2,659,069 | 11/1953 | Kinsella | 362/92 |
| 2,777,050 | 1/1957 | O'Keefe | 362/92 |
| 4,322,780 | 3/1982 | Murakami et al. | 362/31 |
| 4,443,835 | 4/1984 | Brautigam et al. | 362/300 |
| 4,810,044 | 3/1989 | Dahnert | 312/223 |
| 4,870,546 | 9/1989 | Hammerl et al. | 362/92 |

FOREIGN PATENT DOCUMENTS

| | | | |
|---|---|---|---|
| 2202044 | 9/1988 | United Kingdom | 126/213 |

*Primary Examiner*—Y. My Quach
*Attorney, Agent, or Firm*—Mark W. Borgman

[57] ABSTRACT

An indicator for an appliance includes a light bar formed of molded plastic material. The bar is interconnected to the control elements of the appliance so the periphery of the bar lights whenever any element of the appliance is active. The bar is designed so the periphery of the light bar is exposed along the exterior edge of the appliance.

3 Claims, 2 Drawing Sheets

INDICATOR LIGHT FOR AN APPLIANCE

BACKGROUND OF THE INVENTION

The present invention relates to an indicator light for an appliance. The indicator light is particularly useful for a cooking appliance, but can also be used for other home appliances such as dishwashers, washers, dryers and microwave ovens.

It is common in the industry to provide an indicator light on cooking appliances that is illuminated during operation of any of the cooking elements. This is done, for example, by placing a light source such as a light emitting diode on the front or top of the appliance. This light source is then interconnected to each of the control elements so that activation of any of the surface cooking elements also activates this light. Another approach is that of backlighting the control knobs so an indication is provided as to which of the elements is active.

Placing an indicator light on the front of the appliance is not considered to provide an aesthetically pleasing design. Additionally, a light placed in the front or top of the appliance cannot always be seen from all angles. This is frequently important because a consumer may move about the kitchen. Additionally, it is common for more than one person to be in the kitchen. It is therefore important to have an indicator that is generally visible throughout the kitchen. While the backlighting of the control knobs provides a more aesthetically pleasing indication, it suffers from the inability to be seen from all angles. These approaches, while adequate, do not provide a complete solution to the need.

Therefore, it is an object of the present invention to provide an indicator light for an appliance that is easily visible from many angles.

A further object of the invention is to provide an indicator light for an appliance that is aesthetically pleasing.

SUMMARY OF THE INVENTION

The foregoing objects are achieved by an indicator light for an appliance comprising a light bar that conforms to the contour of the appliance. The light bar is made from a plastic material, the outer periphery of which is exposed around the control panel of the appliance and which emits light when any element of the appliance is active.

DETAILED DESCRIPTION OF THE PREFERRED EMBODIMENT

Figure 1:
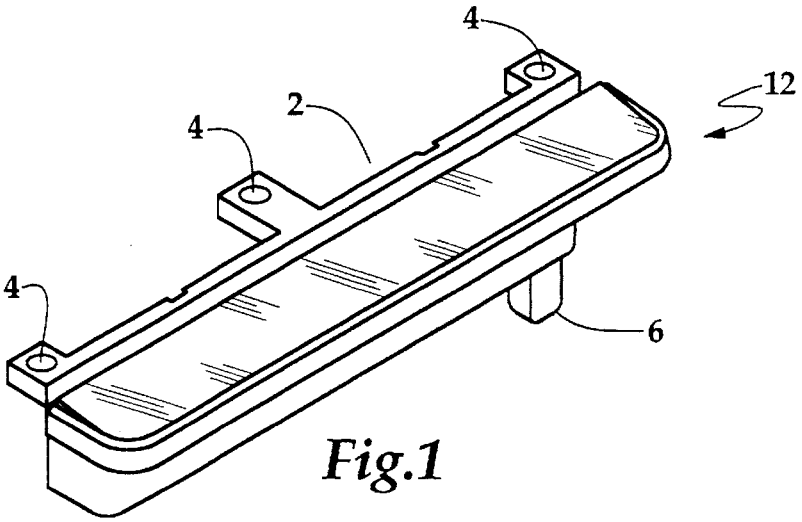
FIG. 1 is an isometric view of a light bar assembly.
Figure 2:
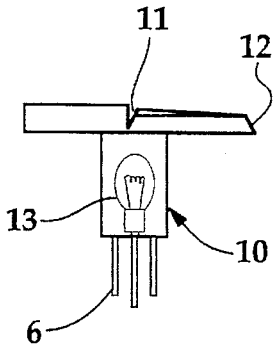
FIG. 2 is side view of the light bar assembly.
Figure 3:
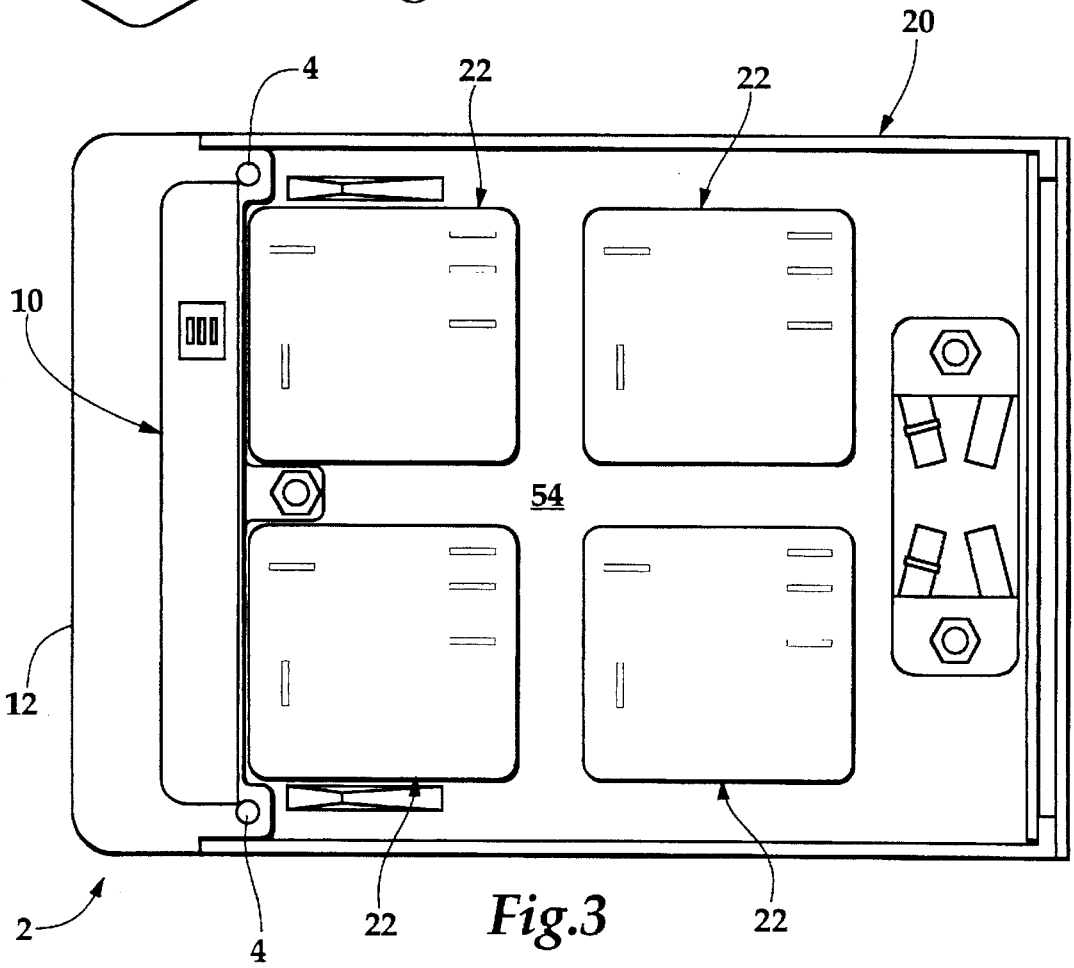
FIG. 3 is a bottom view of the appliance control housing.

Referring to FIGS. 1–4, a cooktop 50 is shown, including booking elements 52 and control elements 56,58,60,62 included in a control housing 54. A light bar 10 is included in the control housing 54 and will be described in detail below. The light bar 10 is mounted into the control housing 54 so that the lighted periphery 12 of the light bar 10 extends around the front edge of the control housing 54. The light bar 10, shown in FIGS. 1 and 2, is formed of molded plastic.

Incandescent lamps 13 are housed in the light bar 10. The light is directed to the periphery 12 of the light bar 10 via a reflecting bar 11 within the light bar 10. When the incandescent lamps 13 are illuminated the light from the lamps is directed towards the top of the light bar 10. The top of the light bar 10 includes a reflecting bar 11. The reflecting bar 11 is formed to reflect light impinging upon it towards the periphery 12 of the light bar 10. Thus, light from the lamps 13 is redirected upon hitting the reflecting bar 11 to illuminate the periphery 12 of the light bar 10.

The molded plastic may be colored to accentuate the light. For example, in the present design the light is used as an indication of activation of a cooking element; the plastic is appropriately red. When the lamps 13 are activated the periphery 12 of the light bar 10 is illuminated and appears as a line of red light. This reddish color is generally recognized by users as an activation indication.

Figure 5:
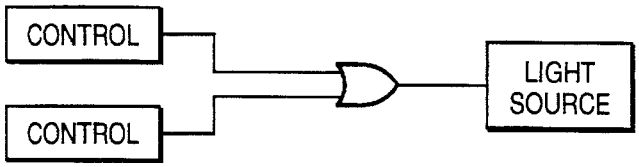
FIG. 5 is a logic circuit diagram of the connections to the light bar.
Figure 4:
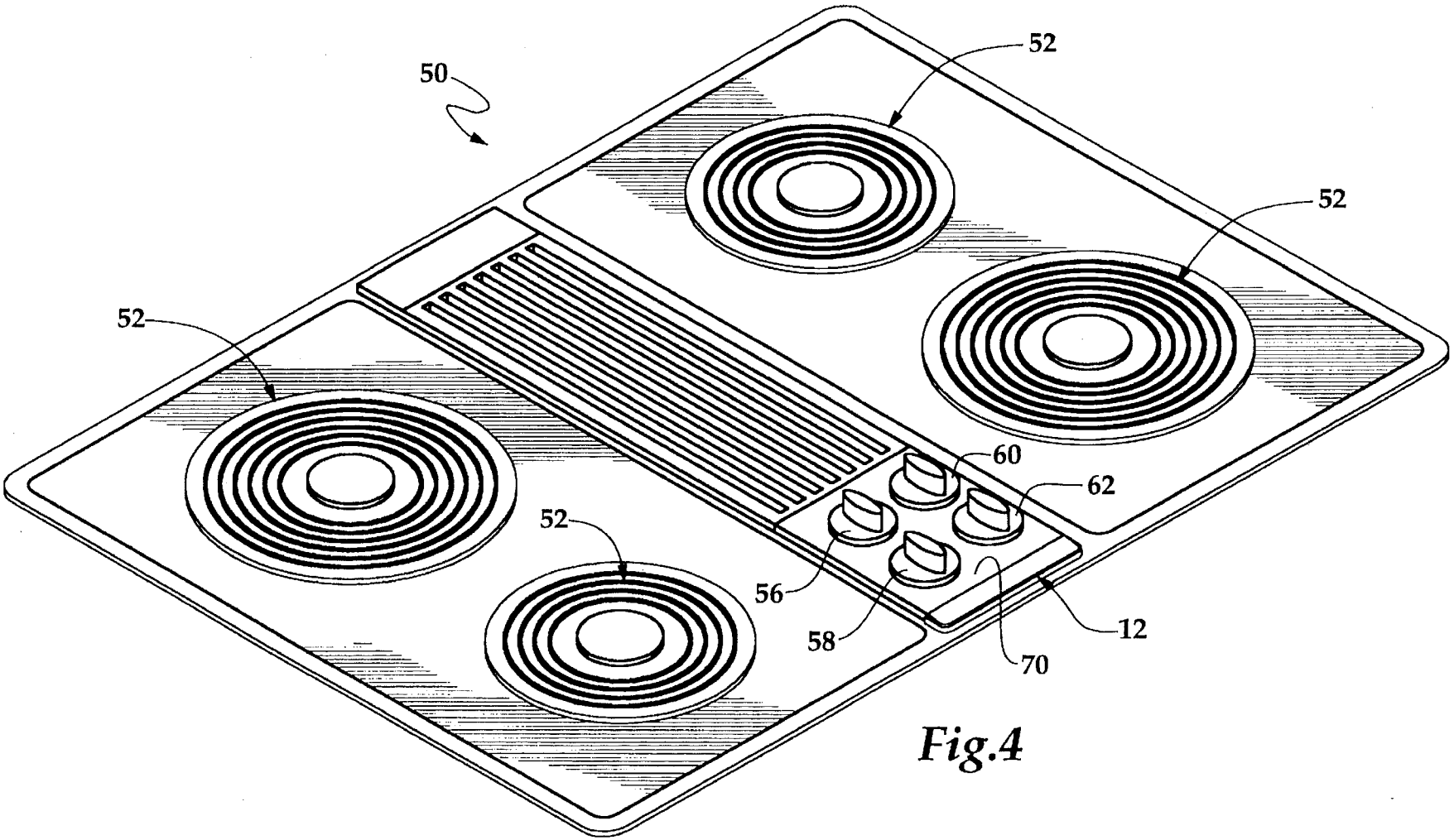
FIG. 4 is a plan view of a cooktop incorporating a light bar.

The light bar 10 further includes fastener tabs 4, for fastening the light bar 10 to the control housing 54. An electrical connecter 6 is provided on the bottom of the light bar 10 to provide power to the lamps 13. The control housing 54 includes locations 22 for each of the control elements 56,58,60,62. An electrical interconnection is provided so that upon activation of any of the healing surface control elements 56,58,60,62 electrical power is provided to activate the lamps 13 in the light bar 10. This can be done either via a hard-wired electrical circuit connection or under the control of a microprocessor control if available. As shown in FIG. 5, if any of several control elements is activated, power is interconnected to the lamps 13. These signals are connected in a logical "OR" so activation of any element illuminates the light bar 10. The light bar is attached to the control housing 54 via screws or other fasteners (not shown) through the fastener tabs 4.

The control housing 54 is mounted to a cooktop 50. The outer periphery 12 of the light bar 10 is exposed along the front of the cooktop 50. A facia 70 is attached to the top of the control housing 54, covering all but the outer periphery of the light bar 10. In this way, the light 10 becomes integral to the control housing 54.

Upon activation of any of the control elements 56,58,60, 62 power is supplied to the lamps 13 of the light bar 10 as described previously. The outer periphery 12 is then illuminated, giving an aesthetically pleasing indication of activation. Because the light bar periphery 12 extends around the front and sides of the control housing 54, the indication light is visible from either side and the front of the cooktop. Thus, the outer periphery 12 of the light bar 10 extends in more than one plane. This allows a user to identify activation of a heating element from a wide range of angle and distances from the appliance.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A cooking element activation indicator for a cooking appliance comprising:

a control housing mounted to a cooking appliance;

an indicator light bar having a peripheral edge extending in more than one plane and mounted to the control housing;

a plurality of cooking elements mounted to the cooking appliance and operatively connected to user activated controls, the controls mounted in the control housing;

a light source within said indicator light bar;

an electrical circuit for activating said light source to emit light whenever a cooking element of the cooking appliance is activated by the user activated controls, light from said light source illuminating the edge of said indicator light bar and indicating that a cooking element is activated.

2. The activation indicator of claim 1 and wherein the indicator light bar being integrally mounted to the control housing.

3. An appliance activation indicator comprising:

a plurality of cooking elements mounted in a cooking appliance;

a control housing mounted in the appliance and having a peripheral edge;

a control for controlling the cooking elements, the control mounted in the control housing;

an indicator light bar having a periphery edge extending in more than one plane and being electrically connected to the control for selective activation or deactivation coinciding with activation and deactivation of the cooking elements, the indicator light bar being mounted in the control housing;

a light source for emitting light within the indicator light bar;

the light emitted from the light source being directed to the periphery edge of the indicator light bar;

the indicator light bar being mounted to the cooking appliance so that the periphery edge of the indicator light bar is visible;

the periphery edge of the indicator light bar conforming to the peripheral edge of the control housing;

the control activating the light source upon activation of any of the cooking elements.

* * * * *